US009414650B2

(12) United States Patent
Hayashi et al.

(10) Patent No.: US 9,414,650 B2
(45) Date of Patent: Aug. 16, 2016

(54) SLIDE FASTENER

(75) Inventors: Akio Hayashi, Toyama (JP); Toshiyuki Jyougan, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/383,615

(22) PCT Filed: Mar. 30, 2012

(86) PCT No.: PCT/JP2012/058569

§ 371 (c)(1),
(2), (4) Date: Sep. 8, 2014

(87) PCT Pub. No.: WO2013/145257

PCT Pub. Date: Oct. 3, 2013

(65) Prior Publication Data

US 2015/0107062 A1 Apr. 23, 2015

(51) Int. Cl.

| | |
|---|---|
| ***A44B 19/02*** | (2006.01) |
| ***A44B 19/42*** | (2006.01) |
| ***A44B 19/00*** | (2006.01) |
| ***A44B 19/14*** | (2006.01) |

(52) U.S. Cl.

CPC ..... *A44B 19/42* (2013.01); *A44B 19/00* (2013.01); *A44B 19/02* (2013.01); *A44B 19/14* (2013.01); *Y10T 24/2539* (2015.01)

(58) Field of Classification Search

CPC ..... A44B 19/02; A44B 19/42; A44B 19/04; Y10T 24/2539

See application file for complete search history.

(56) References Cited

U.S. PATENT DOCUMENTS

| | | | | |
|---|---|---|---|---|
| 1,660,192 | A * | 2/1928 | Freysinger | 24/411 |
| 2,496,946 | A | 2/1950 | Legat | |
| 2010/0071115 | A1 | 3/2010 | Sadato | |

FOREIGN PATENT DOCUMENTS

| | | | |
|---|---|---|---|
| JP | 3-247306 | A | 11/1991 |
| JP | 04024004 | A * | 1/1992 |
| JP | 2000-41713 | A | 2/2000 |
| JP | 2004-16751 | A | 1/2004 |
| JP | 2005-344218 | A | 12/2005 |
| JP | 2008-069487 | A | 3/2008 |
| WO | 2011/125176 | A1 | 10/2011 |

OTHER PUBLICATIONS

English Translation of JP 2004-16751.*
English Translation of JP 2005-344218.*
English Translation of JP 4-24004.*
International Search Report, PCT Application No. PCT/JP2012/058569 mailed Jun. 19, 2012.
Written Opinion, PCT Application No. PCT/JP2012/058569 mailed Jun. 19, 2012.
Office Action, Japanese Patent Application No. 2014-507220, mailed Jul. 7, 2015.

* cited by examiner

*Primary Examiner* — Abigail Morrell
(74) *Attorney, Agent, or Firm* — Kilpatrick Townsend & Stockton LLP

(57) ABSTRACT

There is provided a slide fastener. A pair of core sections are respectively provided along opposing tape side edge portions of a pair of fastener tapes. A pair of fastener element rows are respectively attached to the pair of core sections. Each of the pair of fastener element rows includes a plurality of fastener elements made of metal. Silica is applied to surfaces of the core sections and the fastener elements.

6 Claims, 8 Drawing Sheets

SLIDE FASTENER

This application is a national stage application of PCT/JP2012/058569, which is incorporated herein by reference.

TECHNICAL FIELD

The present invention relates to a slide fastener.

BACKGROUND ART

There is known a slide fastener which includes a pair of fastener tapes, a pair of core strings respectively provided on opposing tape side edge portions of the pair of fastener tapes, a pair of fastener element rows respectively provided on the pair of core strings, each of the pair of fastener element rows having a plurality of fastener elements made of metal, and a slider configured to engage and disengage the pair of fastener element rows.

It is important for the slide fastener to maintain the engaged state, and the slide fastener is required to exhibit a preset level of engagement strength in several tests. Examples of such tests include a test of measuring the strength of engagement between fastener elements by grasping a pair of fastener tapes which are engaged with each other and pulling the pair of fastener tapes in the direction in which the fastener tapes are away from each other (horizontal pulling strength test) or a test of measuring the strength of engagement by applying a force to the portions where the fastener elements are engaged in a direction from the backside to the front side with using a rod-shaped member (thrust-up strength test).

In order to improve the engagement strength, it is considered to increase the area where the fastener elements are engaged and in contact with each other by changing the shape of engagement sections of the fastener elements. However, increase in the contact area leads to increase in the size of the engagement sections, and thus there is a problem in that engagement or disengagement is not smoothly performed when the slider is operated.

On the other hand, the horizontal pulling strength or the thrust-up strength of the fastener elements can be improved by decreasing the distances between the fastener elements attached to the core strings of the fastener tapes to be smaller than typical distances. However, this case also has a problem in that engagement or disengagement is not smoothly performed when the slider is operated.

As such, improvement in the engagement strength is closely related to the operation of the slider, and their balance is important.

In addition, although distances (pitches) at which the fastener elements are attached are set considering the elasticity of the fastener tapes, when a force is applied to the fastener elements which are attached to the core strings of the fastener tapes, the distances increase in response to inclination or minute movement of the fastener elements, thereby decreasing the engagement strength. This is known through the studies of the inventor of this application.

There is known a slide fastener of the related art in which lacquer is applied to fastener tapes and core strings to stiffen the fastener tapes and the core strings, thereby preventing fastener elements from moving (e.g. see Patent Document 1).

PRIOR ART DOCUMENT

Patent Document

Patent Document 1: U.S. Pat. No. 2,496,946

SUMMARY OF INVENTION

Problems to be Solved by Invention

However, in the slide fastener described in Patent Document 1 above, as the portions of the fastener between the fastener elements are stiffened by the lacquer, the slider is difficult to operate.

The present invention has been made keeping in mind the above problems, and an object of the present invention is to provide a slide fastener in which the engagement strength between fastener elements can be improved while the operability of a slider is maintained.

Means for Solving Problems

The object of the present invention is achieved by the following configurations.

(1) A slide fastener comprising: a pair of fastener tapes; a pair of core sections respectively provided along opposing tape side edge portions of the pair of fastener tapes; and a pair of fastener element rows respectively attached to the pair of core sections, each of the pair of fastener element rows including a plurality of fastener elements made of metal, wherein silica is applied to surfaces of the core sections and the fastener elements.

(2) The slide fastener according to (1), wherein the silica is applied to engagement head sections of the fastener elements.

(3) The slide fastener according to (1) or (2), wherein softening agent is applied to the pair of fastener tapes.

(4) The slide fastener according to (3), wherein anti-bleeding agent is applied to the pair of fastener tapes, and at least the fastener tapes are dyed with a pattern.

(5) The slide fastener according to (4), wherein fluorine compound is applied to the pair of fastener tapes, and at least the fastener tapes are dyed with a pattern.

(6) The slide fastener according to any one of (1) to (5), wherein end stops are attached to the core sections to which the silica is applied.

Advantageous Effects of Invention

According to the slide fastener of the present invention, as the silica is applied to the core sections of the fastener tapes, it is possible to increase the frictional force between threads that form the portions of the fastener tapes in the vicinity of the core sections, thereby preventing the posture of the fastener elements attached to the core sections from being changed. In addition, as the silica is applied to the surfaces of the fastener elements, it is possible to increase the frictional force between the engaged fastener elements, thereby improving the thrust-up strength. Owing to these features, it is possible to improve the engagement strength of the fastener elements while maintaining the operability of the slider.

In addition, according to the slide fastener of the present invention, since the silica is applied to the engagement head sections of the fastener elements, it is possible to further improve the thrust-up strength of the fastener elements.

Furthermore, according to the slide fastener of the present invention, since the softening agent is applied to the fastener tapes, the fastener tapes can become flexible, thereby improving the operability of the slider.

In addition, according to the slide fastener of the present invention, since the anti-bleeding agent is applied to the fastener tapes, the fastener tapes can be beautifully printed by ink jet.

Furthermore, according to the slide fastener of the present invention, since the fluorine compound is applied to the fastener tapes, the fluorine compound may act as a water/oil repellent. When the fastener tapes are printed by ink jet, ejected ink droplets may not be easily absorbed in the fastener tapes. This can consequently prevent ejected ink droplets from spreading beyond an intended range, whereby the fastener tapes can be beautifully printed by ink jet.

In addition, according to the slide fastener of the present invention, since the end stops are attached to the core sections to which the silica is applied, the silica can improve the attachment strength of the end stops.

BRIEF DESCRIPTION OF DRAWINGS

FIGS. 2A to 2C are views illustrating the fastener elements shown in FIG. 1, in which FIG. 2A is a front view of the fastener elements, FIG. 2B is a top-plan view of the fastener element, and FIG. 2C is a bottom view of the fastener element;

EMBODIMENTS OF INVENTION

Hereinafter, embodiments of a slide fastener according to the present invention will be described in detail with reference to the accompanying drawings. In the following description, as for fastener tapes, a front side refers to a near side with respect to the paper surface of FIG. 1, a back side refers to a far side with respect to the paper surface of FIG. 1, an upper side refers to an upper side with respect to the paper surface of FIG. 1, a lower side refers to a lower side with respect to the paper surface of FIG. 1, a left side refers to a left side with respect to the paper surface of FIG. 1, and a right side refers to a right side with respect to the paper surface of FIG. 1. In addition, the right and left direction of the fastener tapes is also referred to as a width direction. Furthermore, the upward and downward direction of the fastener tapes is also referred to as a longitudinal direction.

First Embodiment

First, a first embodiment of the slide fastener according to the present invention will be described with reference to FIG. 1 to FIG. 7.

Figure 1:
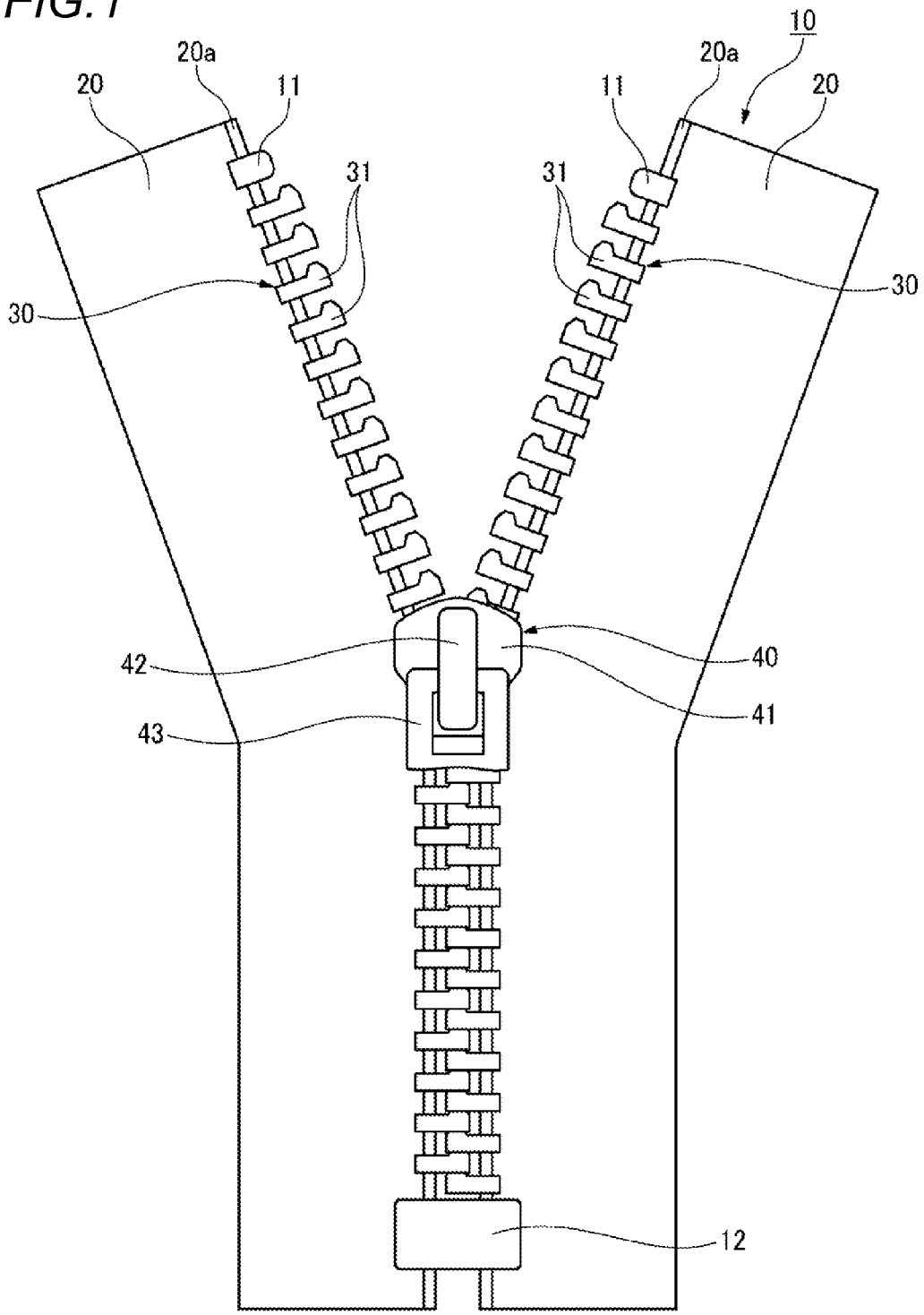
FIG. 1 is a front view illustrating a slide fastener according to a first embodiment of the present invention.
Figure 2A:
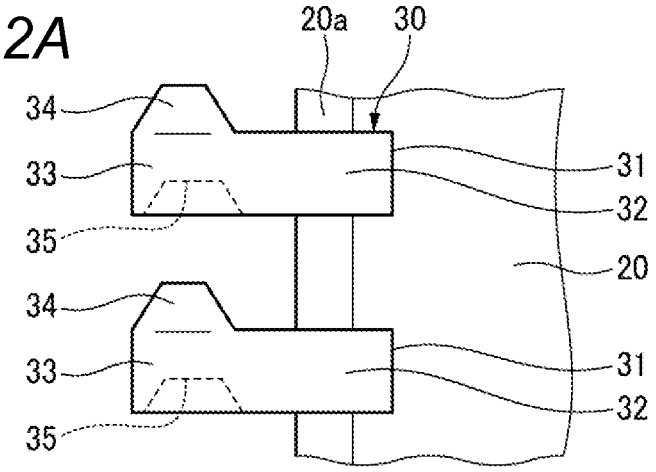
Figure 2B:
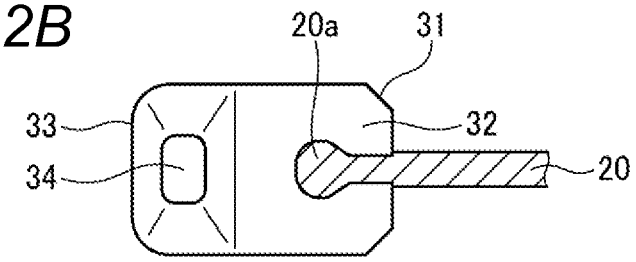
Figure 2C:
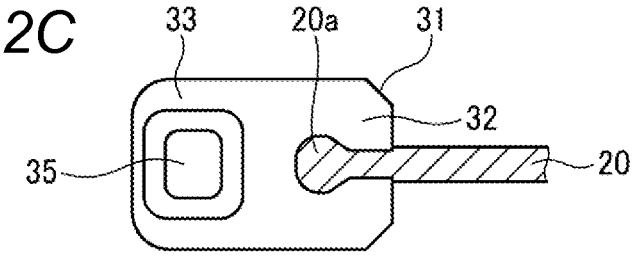

As shown in FIG. 1, the slide fastener 10 according to this embodiment includes a pair of right and left woven fastener tapes 20, a pair of right and left core sections 20*a* respectively provided along opposing tape side edge portions of the pair of right and left woven fastener tapes 20, a pair of right and left fastener element rows 30 respectively attached to the pair of right and left core sections 20*a*, each of the pair of fastener element rows 30 including a plurality of fastener elements 31 made of metal, a slider 40 configured to engage and disengage the pair of right and left fastener element rows 30, top end stops 11 respectively provided on the top end portions of the pair of right and left fastener element rows 30, and a bottom end stop 12 provided on the bottom end portions of the pair of right and left fastener element rows 30. Intended usages of the slide fastener 10 may include, but not limited to, clothes, bags, shoes and industrial materials. The top end stops 11 and the bottom end stop 12 are end stops configured to stop the slider 40 sliding. In addition, core strings are woven to the core sections 20*a* at the time of the weaving of the fastener tapes 20. The dimension of each of the core sections 20*a* in the front and back direction is greater than the dimension of sections of the fastener tapes that are outward from the core sections 20*a* (also referred to tape sections of the fastener tapes 20). As shown in FIGS. 2A to 2C, the core sections 20*a* have a bulged-shape.

Each of the fastener element rows 30 includes the plurality of fastener elements 31. The plurality of fastener elements 31 are made of, for example, red brass, aluminum or nickel, and are attached to the corresponding core section 20*a* of the fastener tapes 20 by crimping. The fastener tapes 20 are made by weaving fibers of polyester.

As shown in FIGS. 2A to 2C, each of the fastener elements 31 includes a base section 32 which is attached to the core section 20*a* of the corresponding fastener tape 20 and an engagement head section 33 which extends from the base section 32 toward the counterpart fastener tape 20 and is engaged with an opposite fastener element 31.

Figure 3:
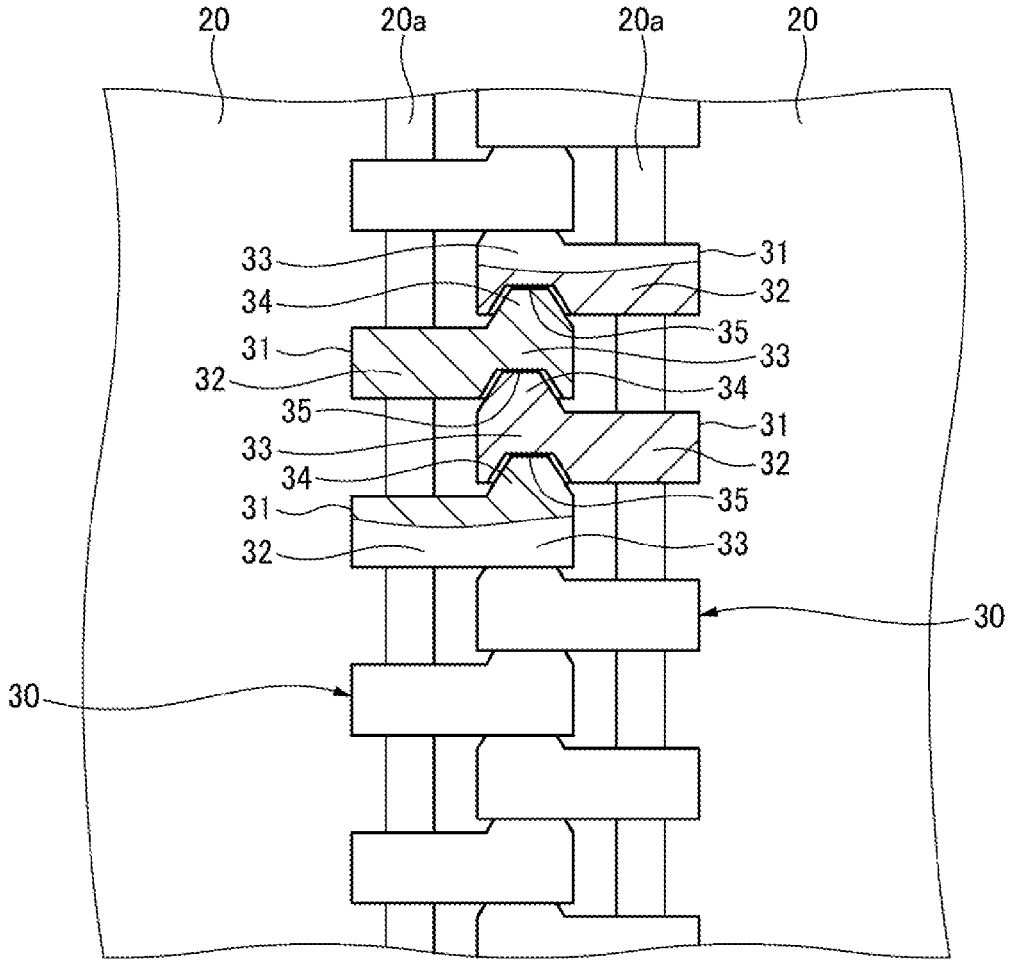
FIG. 3 is an enlarged front view illustrating the pair of fastener element rows which are engaged with each other.
Figure 4:
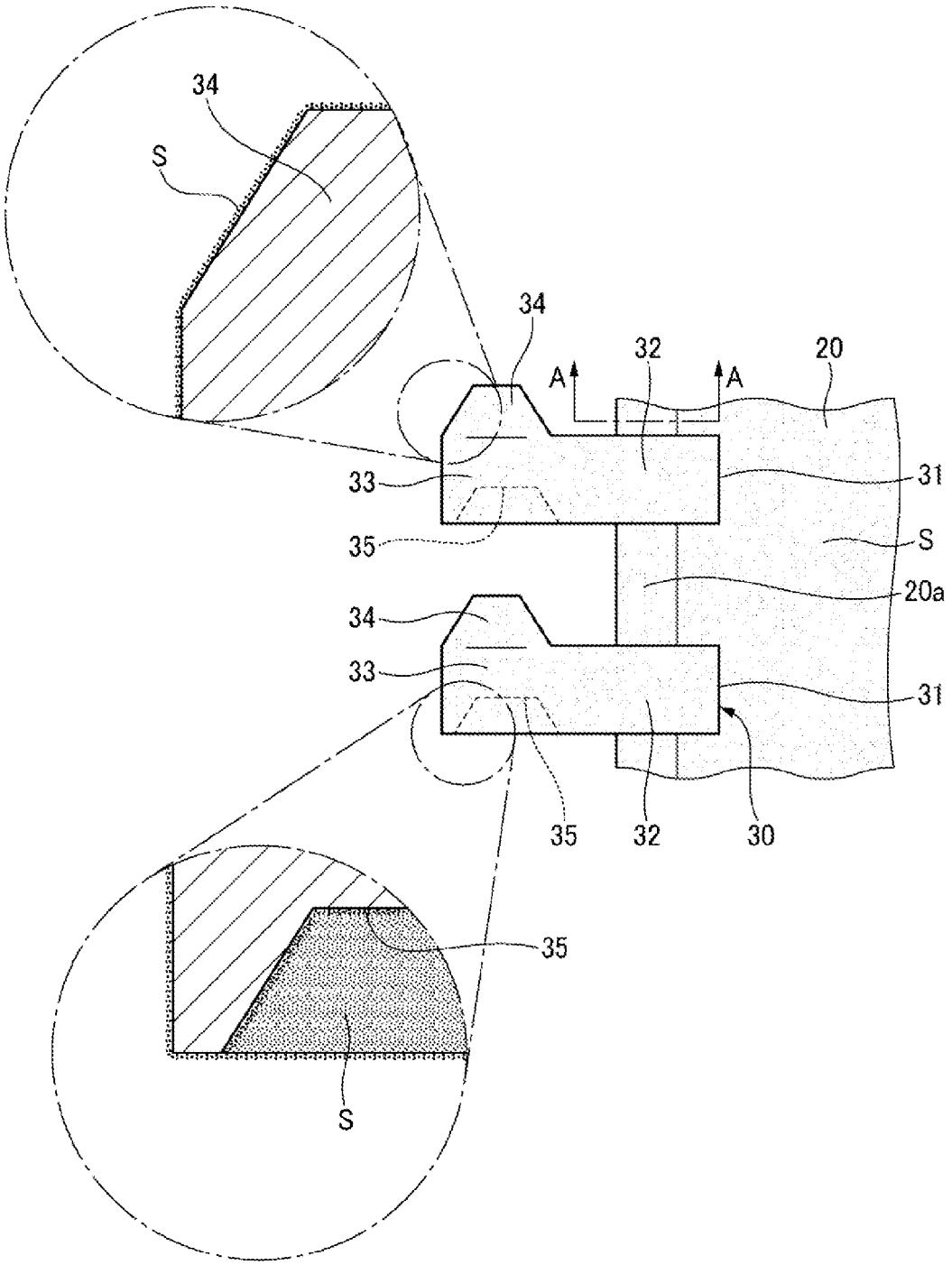
FIG. 4 is a partially enlarged view of the fastener elements shown in FIG. 1.

In addition, an engagement convex section 34 is formed on the top surface of the engagement head section 33, and an engagement concave section 35 is formed on the bottom surface of the engagement head section 33. Thus, as shown in FIG. 3, when the right and left fastener element rows 30 are engaged with each other, the engagement convex section 34 of the fastener element 31 at one side enters the engagement concave section 35 of the fastener element 31 at the other side while the engagement convex section 34 of the fastener element 31 at the other side enters the engagement concave section 35 of the fastener element 31 at one side.

As shown in FIG. 1, the slider 40 includes a body 41, a pull-tab attachment section 42 provided on the top surface of the body 41 and a pull-tab 43 attached to the pull-tab attachment section 42. When the slider 40 is moved toward the top end stops 11 (toward the upper side), the pair of right and left fastener element rows 30 are engaged with each other. When the slider 40 is moved toward the bottom end stop 12 (toward the lower side), the pair of right and left fastener element rows 30 are disengaged from each other.

In addition, according to this embodiment, silica (silicon oxide) S is applied to the surface of the right and left fastener tapes 20 and the right and left fastener elements 31 (see FIG. 4) and softening agent is applied to the right and left fastener tapes 20. Furthermore, the silica S is applied to the entire surfaces of the base sections 32 and the engagement head sections 33 of the fastener elements 31. Silica is a type of silicon oxide, and more particularly, a material that is composed of silicon dioxide ($SiO_2$).

Figure 5:
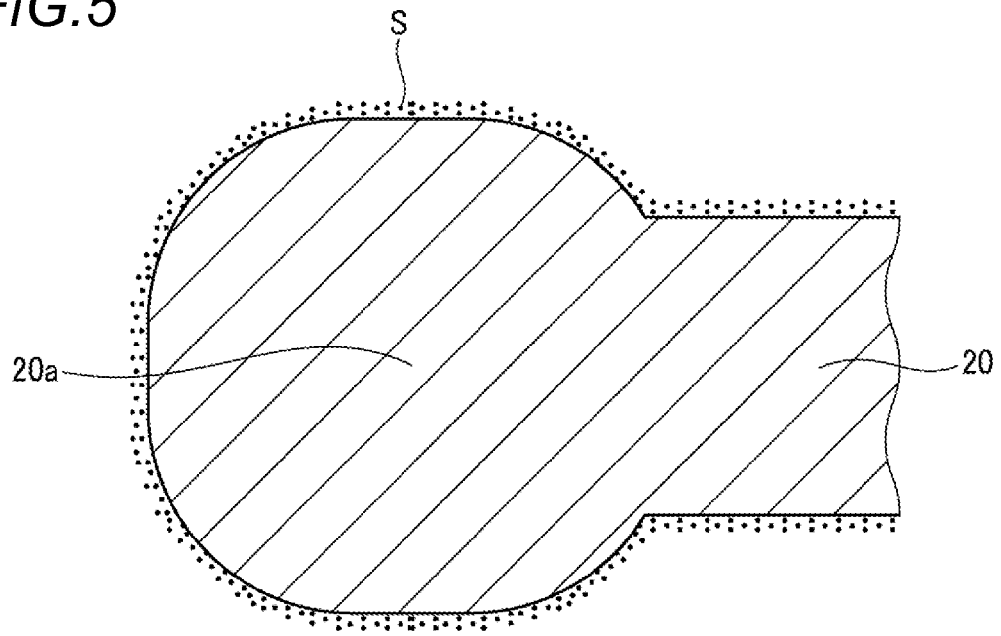
FIG. 5 is a cross-sectional view taken along line A-A in FIG. 4.

Therefore, as shown in FIG. 5, the silica S and the softening agent are applied to the core sections 20*a* of the right and left fastener tapes 20. The top end stops 11 and the bottom end stop 12 are attached to the core sections 20*a* to which the silica S is applied. Thus, the silica S is applied to the inner side of the top end stops 11 and the bottom end stop 12, and the attachment strength of the top end stops 11 and the bottom end stop 12 is increased. The strength refers to sliding strength with respect to the longitudinal direction of the fastener tapes 20.

Examples of silica-applying treatment may include applying solution of organic silicon compound containing silane coupling agent consisting primarily of silica particles on the fastener tapes 20 and the fastener elements 31, followed by drying. Alternatively, the silica-applying treatment may include pouring the solution into a bath and dipping the fastener chain into the bath.

Examples of the softening agent may include cation-based softening agent, anion-based softening agent, non-ionic softening agent, complex softening agent and silicon softening agent.

As described above, in the slide fastener 10 according to this embodiment, as the silica S is applied to the core sections 20*a* of the fastener tapes 20, it is possible to increase the frictional force between threads that form the portions of the fastener tapes 20 in the vicinity of the core sections 20*a*, thereby preventing the posture of the fastener elements 31 attached to the core sections 20*a* from being changed. In addition, as the silica S is applied to the surfaces of the fastener elements 31, it is possible to increase the frictional force between the engaged fastener elements 31, thereby improving thrust-up strength. Owing to these features, it is possible to improve the engagement strength of the fastener elements 31 while maintaining the operability of the slider 40.

In addition, in the slide fastener 10 according to this embodiment, since the silica S is applied to the engagement head sections 33 of the fastener elements 31, it is possible to further improve the thrust-up strength of the fastener elements 31.

Furthermore, in the slide fastener 10 according to this embodiment, since the softening agent is applied to the fastener tapes 20, the fastener tapes 20 can become flexible, thereby improving the operability of the slider 40. Although there is a possibility that the flexible fastener tapes 20 may cause a minute change in the posture to the fastener elements 31, the application of the silica S to the fastener tapes 20 cause friction between the threads that compose the core sections 20*a* of the woven fastener tapes 20. It is therefore possible to prevent the fastener tapes 20 from being excessively flexible while obtaining flexibility from the softening agent. Accordingly, it is possible to suppress a change in the posture of the fastener elements 31 attached to the core sections 20*a* of the fastener tapes 20.

In addition, in the slide fastener 10 according to this embodiment, since the top end stops 11 and the bottom end stop 12 are attached to the core sections 20*a* to which the silica S is applied, the silica S is interposed between the top end stops 11 and the core sections 20*a* and between the bottom end stop 12 and the core sections 20*a*. This can consequently improve the sliding strength of the top end stops 11 and the bottom end stop 12.

Figure 6:
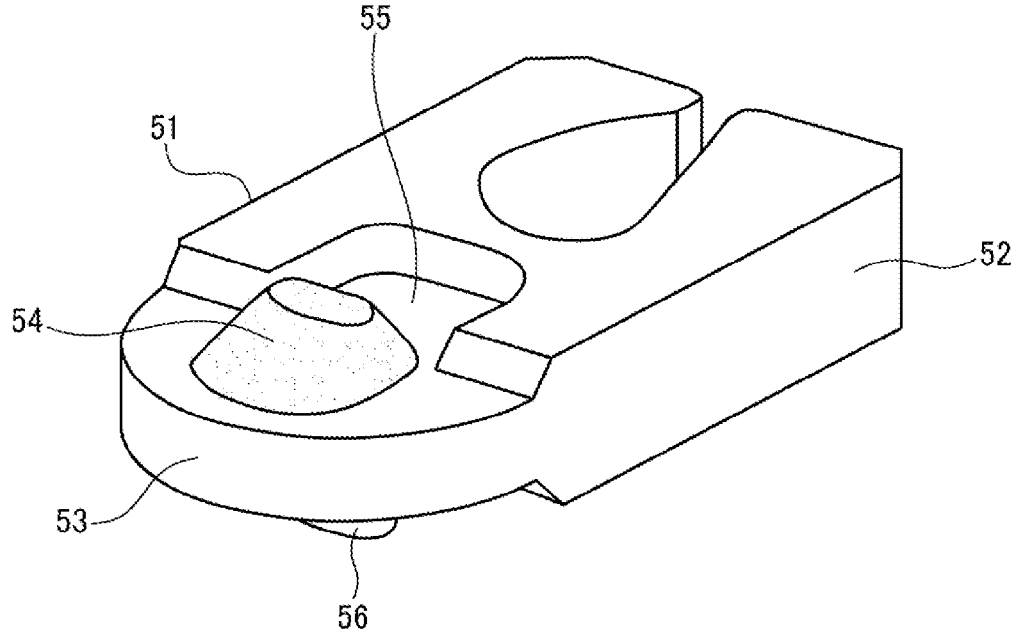
FIG. 6 is a perspective view illustrating a fastener element of a slide fastener according to a modified example of the first embodiment.

As a modified example of this embodiment, the fastener elements 31 may be fastener elements 51, as shown in FIG. 6. As shown in FIG. 6, each of the fastener elements 51 includes a base section 52 which is attached to a corresponding core section 20*a* of the fastener tapes 20 and an engagement head section 53 which extends from the base section 52 toward the counterpart fastener tape 20 and is engaged with an opposing fastener element 51.

Figure 7:
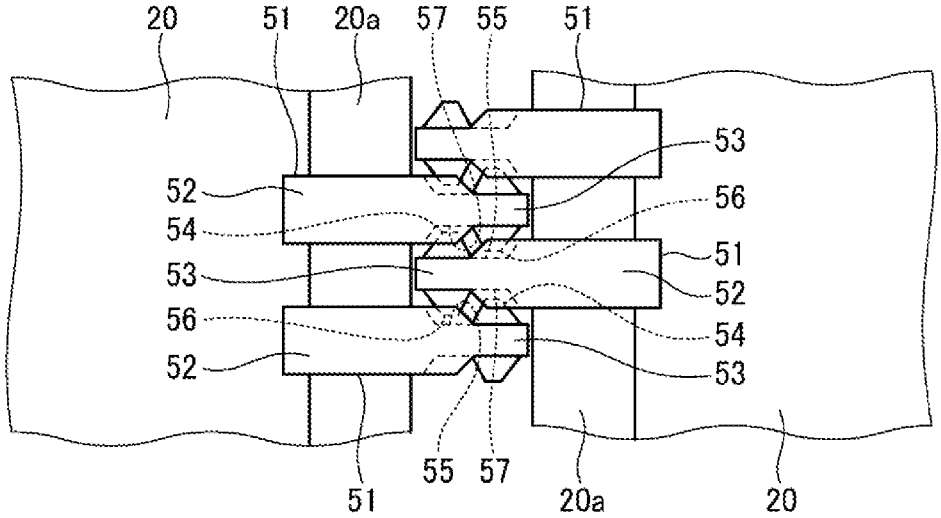
FIG. 7 is an enlarged front view illustrating the pair of fastener element rows which are engaged with each other in the modified example shown in FIG. 6.

In addition, as shown in FIG. 6 and FIG. 7, a first engagement convex section 54 is formed on the top surface of the engagement head section 53 at a side of the leading end thereof, and a first engagement concave section 55 is formed on the top surface of the engagement head section 53 at a side of the base section 52 relative to the first engagement convex section 54. Furthermore, a second engagement convex section 56 is formed on the bottom surface of the engagement head section 53 at a side of the leading end thereof, and a second engagement concave section 57 is formed on the bottom surface of the engagement head section 53 at a side of the base section 52 relative to the second engagement convex section 56. Accordingly, the engagement head section 53 is formed symmetrical in the upward and downward direction.

Therefore, as shown in FIG. 7, when engaging the right and left fastener element rows 30 with each other, the first engagement convex section 54 of the fastener element 51 at one side enters the second engagement concave section 57 of the fastener element 51 at the other side while the second engagement convex section 56 of the fastener element 51 at the other side enters the first engagement concave section 55 of the fastener element 51 at one side. At the same time, the second engagement convex section 56 of the fastener element 51 at one side enters the first engagement concave section 55 of the fastener element 51 at the other side while the first engagement convex section 54 of the fastener element 51 at the other side enters the second engagement concave section 57 of the fastener element 51 at one side.

In addition, according to this modified example, as shown in FIG. 6, the silica (silica oxide) S is applied only to the surfaces of the right and left faster tapes 20 and the first and second engagement convex sections 54 and 56 of the right and left fastener elements 31.

Second Embodiment

Figure 8:
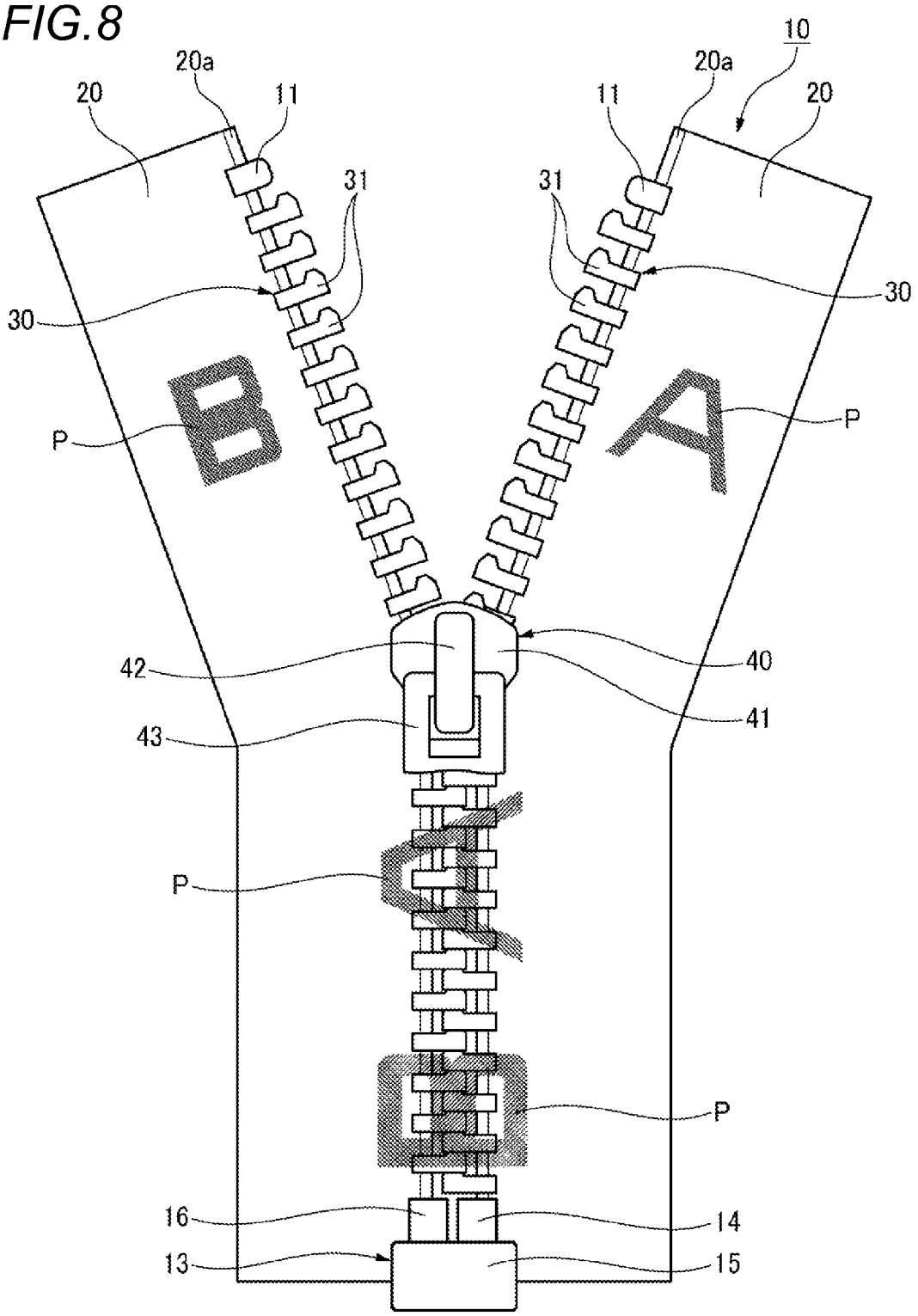
FIG. 8 is a front view illustrating a slide fastener according to a second embodiment of the present invention.

Next, with reference to FIG. 8, a description will be given below of a second embodiment of the slide fastener according to the present invention. The same reference numerals and signs will be used in the drawings in order to designate some components when they are the same as or similar to those of the first embodiment, and descriptions of those components will be omitted or simplified.

According to this embodiment, as well as the foregoing first embodiment, silica (silicon oxide) S is applied to the surfaces of the right and left fastener tapes 20 and the right and left fastener elements (see FIG. 4) while anti-bleeding agent and fluorine compound are applied to the right and left fastener tapes 20. In addition, a preset pattern (color) P is printed (colored) by ink jet on the fastener tapes 20, the fastener elements 31 and the portions of the fastener tapes 20 in the vicinity of the fastener elements 31.

In addition, a separable end stop 13 is provided instead of the bottom end stop 12 of the first embodiment. The separable end stop 13 includes a box pin 14 and a box body 15 which are provided on the bottom end portion of the right fastener element row 30. The separable end stop 13 also includes an insert pin 16 which is provided on the bottom end portion of the left fastener element row 30. The insert pin 16 can be inserted into the box body 15. The separable end stop 13 may be a reverse separable end stop which can be disengaged to the right and left, and can disengage the engaged fastener elements 31 from below. The separable end stop 13 and the reverse separable end stop are also end stops.

Examples of the anti-bleeding agent may include acrylic acid-vinyl alcohol, sodium acrylate polymer, cross-linked product of starch-acrylic acid graft copolymer, cross-linked polyacrylate, polyamines, allylamines, acryls and dicyandiamides. Although the anti-bleeding agent serves to improve the fixation of ink, it also stiffens fibers. Therefore, the same softening agent as in the foregoing first embodiment is added to the anti-bleeding agent.

Examples of the fluorine compound may include poly(pentadecafluorooctyl acrylate), poly(trifluoroethyl acrylate), tetrafluoroethylene-hexafluoropropylene copolymer, perfluorolauric acid, polytetrafluoroethylene, perfluoro-n-alkyl acrylate, polyvinylidene fluoride, pentadecane butyl methacrylate and hexafluoropropylene. In addition, examples of the fluorine compound may also include copolymer composed of two or more types of fluorine-containing olefins and copolymer of fluorine-containing olefin and hydrocarbon monomer.

As set forth above, in the slide fastener 10 according to this embodiment, since the anti-bleeding agent is applied to the fastener tapes 20, the fastener tapes 20 can be beautifully printed by ink jet.

In addition, in the slide fastener according to this embodiment, since the anti-bleeding agent to which the softening agent is added is applied to the fastener tapes 20, the fastener tapes 20 can be made flexible, thereby improving the operability of the slider 40. Although there is a possibility that a minute change in posture is caused in the fastener elements 31 since the fastener tapes 20 are made flexible, the application of the silica S to the fastener tapes 20 causes friction between the threads which compose the core sections 20*a* of the woven fastener tapes 20. It is therefore possible to prevent the fastener tapes 20 from being excessively flexible while flexibility is obtained from the softening agent. Accordingly, it is possible to reduce a change in the posture of the fastener elements 31 attached to the core sections 20*a* of the fastener tapes 20.

Furthermore, in the slide fastener 10 according to this embodiment, since the fluorine compound is applied to the fastener tapes 20, the fluorine compound may act as a water/oil repellent. When the fastener tapes 20 are printed by ink jet, ejected ink droplets may not be easily absorbed in the fastener tapes 20. This can consequently prevent ejected ink droplets from spreading beyond an intended range, whereby the fastener tapes 20 can be beautifully printed by ink jet.

In addition, in the ink jet printing as described above, at least the fastener tapes 20 are dyed with a pattern (including a design, a decoration or a tone by one color). Dyeing is carried out by ink adhesion with using the ink jet printing, followed by coloring of threads by heating treatment. As shown in FIG. 8, when the fastener elements are also dyed with a pattern, for example, a resin layer is formed on the surfaces of the fastener elements made of metal, and silica is applied to the surface of the resin layer. This resin layer can be dyed through adhesion of ink from the ink jet printing, whereby the fastener elements can also be dyed with a pattern. For the resin layer, for example, polyester or polybutylene terephthalate is considered. In addition, it is possible to directly apply silica to the engagement head sections of the fastener elements made of metal and form the resin layer on the surface portions of the fastener elements except for the engagement head sections.

The other configurations and advantageous effects are the same as those of the first embodiment.

EXAMPLES

Next, in order to confirm the advantageous effects of the present invention, thrust-up strength test was performed on slide fasteners of the present invention and slide fasteners of comparative examples.

Figure 9:
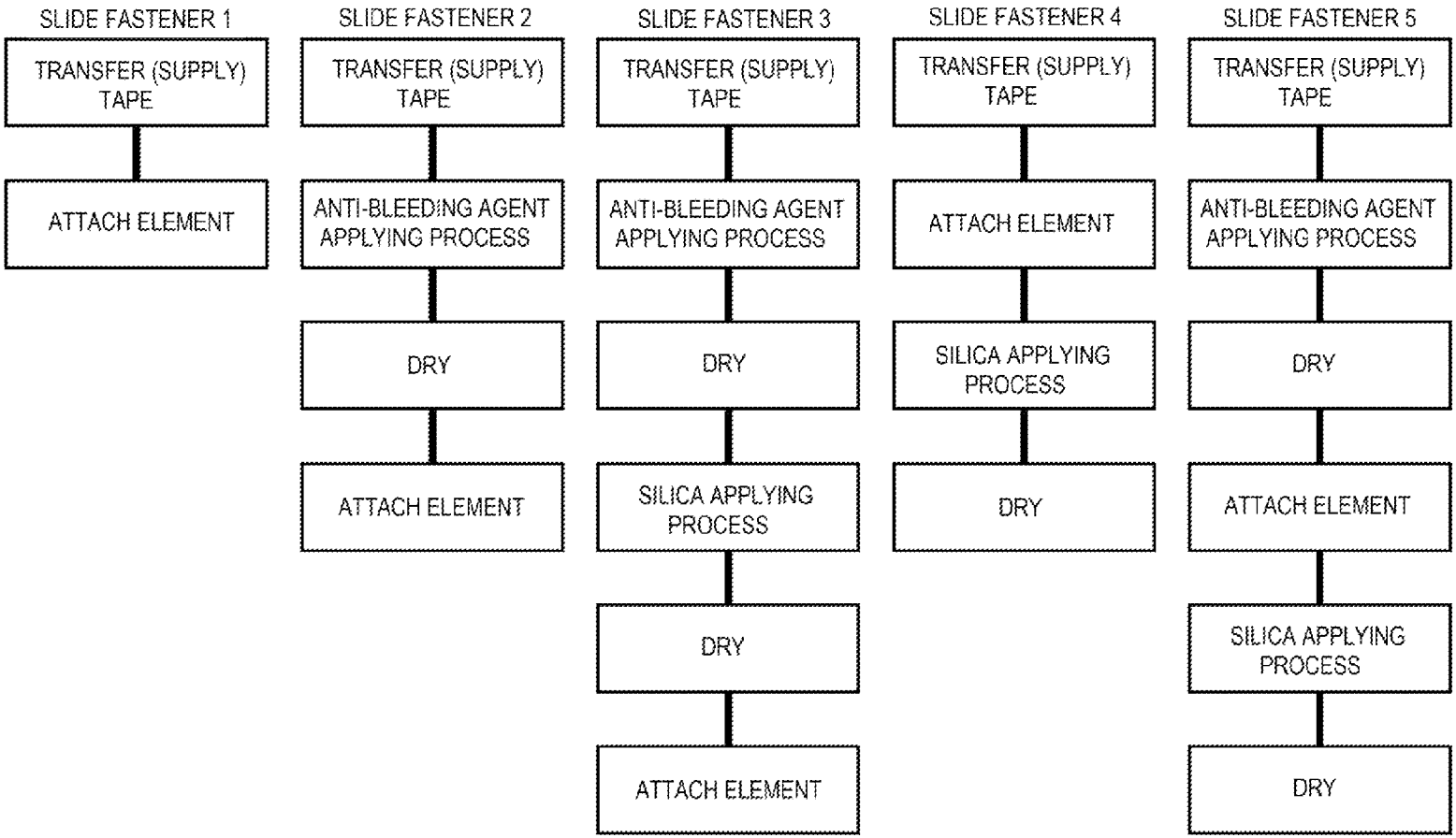
FIG. 9 is a diagram illustrating fabrication processes of slide fasteners 1 to 5 which are used in a thrust-up strength test.

In this test, slide fasteners 1 to 5 (No. 1 to No. 5) which will be described later were prepared. As the common specification of the slide fasteners 1 to 5, the fastener tapes are woven from polyester threads, and the fastener elements are made of red brass. In addition, fabrication processes of the slide fasteners 1 to 5 are shown in FIG. 9.

Slide fastener 1 corresponds to a conventional slide fastener in which fastener elements are attached to core sections of fastener tapes.

In slide fastener 2, anti-bleeding agent is applied to fastener tapes and then fastener elements are attached to core sections of the fastener tapes.

In slide fastener 3, anti-bleeding agent and silica are applied to fastener tapes and then fastener elements are attached to core sections of the fastener tapes. Accordingly, no silica is applied to the fastener elements.

In slide fastener 4, fastener elements are attached to core sections of fastener tapes and then silica is applied to the fastener tapes and the fastener elements.

In slide fastener 5, anti-bleeding agent is applied to fastener tapes and then fastener elements are attached to core sections of the fastener tapes. Then, silica is applied to the fastener tapes and the fastener elements. Accordingly, slide fastener 5 corresponds to the slide fastener according to the second embodiment of the present invention.

The silica applying process in the slide fasteners 3 and 4 is performed by applying liquid organic silicon compound that contains silane coupling agent. More specifically,NC-1020 available from Takamatsu Oil & Fat Co. Ltd. and consisting primarily of silica particles was used.

The anti-bleeding agent applying process in the slide fasteners 2, 3 and 5 is performed by applying liquid of polyamine resin containing fluorine compound such that inkjet printing can be beautifully performed, followed by drying. Although the anti-bleeding agent was removed by subsequent reduction treatment, some of the components left on the fastener tapes. The fluorine compound also left on the fastener tapes. In this case, the reduction treatment is implemented as, for example, washing with warm water (80 to 90° C.) or soaping using a soaping additive and soda ash (at about 80° C.).

According to the thrust-up strength test, first, a predetermined load in the upward and downward direction was applied to the slider fasteners, with the right and left fastener element rows thereof being engaged with each other, using a dedicated test apparatus in order to prevent the fastener tapes from being loosened. In the state in which the fastener tapes were subjected to the load, the right and left fastener tapes were grasped with right and left grips of the test apparatus. Afterwards, a thrust-up force was gradually applied to the right and left engaged fastener element rows in the direction from the backside to the front side of the tapes using a rod-shaped member. The thrust-up force was increased, and the value of the thrust-up force when the right and left fastener element rows were disengaged and thus separated from each other was measured as the thrust-up strength of the slide fastener. In this thrust-up strength test, when the trust-up force was applied to the fastener element rows, a load of 0.3 kg was applied in the direction in which the fastener element rows were away from each other in the upward and downward direction (longitudinal direction) of the fastener tapes.

In this test, 10 slide fasteners were prepared for each of slide fasteners 1 to 5 (No. 1 to No. 5), and the average thrust-up strength was calculated for each of slide fasteners 1 to 5. The results are presented in Table 1.

TABLE 1

| Thrust-up Strength (Unit: N) | | | | |
|---|---|---|---|---|
| No. 1 | No. 2 | No. 3 | No. 4 | No. 5 |
| 215.6 | 184.1 | 191.6 | 237.3 | 259.4 |

As apparent from Table 1 above, when conventional slide fastener 1 is regarded as a reference, the thrust-up strength of each of slide fasteners 2 and 3 is less than that of slide fastener 1, whereas the thrust-up strength of each of slide fasteners 4 and 5 is greater than that of slide fastener 1.

In addition, the thrust-up strength of each of slide fasteners 4 and 5 with the fastener elements being applied with silica was significantly improved as compared to slide fastener 3 with the fastener elements being applied with no silica. It is therefore appreciable that the application of silica to the fastener elements had significant effect on the improved thrust-up strength.

Furthermore, concurrently with this test, the operability of slide fasteners 1 to 5 was examined. However, there were no significant difference in the operability of slide fasteners 2 to 5 from that of conventional slide fastener 1.

It is possible to determine whether or not silica (silicon oxide), fluorine compound or anti-bleeding agent is applied to the slide fasteners by surface composition analysis.

In order to detect silica (silicon oxide) or fluorine compound, it is analyzed whether or not silicon (Si) or fluorine (F) is detected from the surface of the fastener tapes and fastener elements. This analysis can be performed by energy dispersive X-ray analysis. More particularly, it is preferable to perform the analysis using a scanning electron microscope which is supplemented to an energy dispersive X-ray spectroscope.

The existence of anti-bleeding agent or softening agent can be determined by performing soxhlet extraction using solvent of carbon tetrachloride and analyzing the resultant extract.

The present invention is not limited to those that were illustrated in the foregoing embodiments but can be suitably changed without departing from the concept of the present invention.

DESCRIPTION OF REFERENCE NUMERALS

10 Slide Fastener
11 Top Stop
12 Bottom Stop
20 Fastener Tape
20*a* Core Section
30 Fastener Element Row
31 Fastener Element
32 Base Section
33 Engagement Head Section
51 Fastener Element
52 Base Section
53 Engagement Head Section
S Silica

The invention claimed is:

1. A slide fastener comprising:
a pair of fastener tapes;
a pair of core sections respectively provided along opposing tape side edge portions of the pair of fastener tapes; and
a pair of fastener element rows respectively attached to the pair of core sections, each of the pair of fastener element rows including a plurality of fastener elements made of metal,
wherein each of the fastener elements includes a base section attached to a corresponding core section and an engagement head section extending from the base section toward a counterpart fastener tape of the pair of fastener tapes and configured to be engaged with an opposite fastener element,
wherein the fastener elements are respectively attached to the core sections at intervals,
wherein silica is applied to the engagement head section and portions of the core sections between adjacent fastener elements, and
wherein end stops are attached to portions of the core sections with applied silica so that the silica is interposed between the end stops and the core sections.

2. The slide fastener according to claim 1, wherein softening agent is applied to the pair of fastener tapes.

3. The slide fastener according to claim 2, wherein anti-bleeding agent is applied to the pair of fastener tapes, and at least the fastener tapes are dyed with a pattern.

4. The slide fastener according to claim 3, wherein fluorine compound is applied to the pair of fastener tapes.

5. The slide fastener according to claim 1,
wherein the base section of each of the fastener elements is crimped onto the core sections from both front and back sides of the core sections,
wherein the portions of the core sections between the adjacent fastener elements are exposed, and
wherein the silica is applied to the exposed portions of the core sections.

6. The slide fastener according to claim 1,
wherein a first engagement convex section is formed on a top surface of the engagement head section and a first engagement concave section is formed on the top surface of the engagement head section between the base section and the first engagement convex section,
wherein a second engagement convex section is formed on a bottom surface of the engagement head section and a second engagement concave section is formed on the bottom surface of the engagement head section between the base section and the second engagement convex section,
wherein in each of the fastener elements, the silica is applied to surfaces of the first and second engagement convex sections.

* * * * *